US006032846A

United States Patent [19]

Clark et al.

[11] Patent Number: 6,032,846

[45] Date of Patent: Mar. 7, 2000

[54] POWER ACTUATED TOOLS WITH POWER ADJUSTMENT MEANS

[75] Inventors: Philip Charles Clark, Vermont South; Brian Douglas Renshaw, Morphett Vale; Robert Urquhart Connell, Hawthorn, all of Australia

[73] Assignee: Ramset Fasteners Pty. Limited, Croydon, Australia

[21] Appl. No.: 09/051,447

[22] PCT Filed: Sep. 18, 1996

[86] PCT No.: PCT/AU96/00590

§ 371 Date: Dec. 23, 1998

§ 102(e) Date: Dec. 23, 1998

[87] PCT Pub. No.: WO97/13620

PCT Pub. Date: Apr. 17, 1997

[30] Foreign Application Priority Data

Oct. 9, 1995 [AU] Australia ..... PN 5854

[51] Int. Cl.[7] ..... B25C 1/14

[52] U.S. Cl. ..... 227/10; 227/9

[58] Field of Search ..... 227/10, 9, 8, 130

[56] References Cited

U.S. PATENT DOCUMENTS

| | | | |
|---|---|---|---|
| 2,765,464 | 10/1956 | Weichold | 227/10 |
| 3,204,400 | 9/1965 | Kvalve | 227/10 |
| 4,119,257 | 10/1978 | Combette et al. | 27/10 |
| 4,134,527 | 1/1979 | Termet | 227/10 |
| 4,153,192 | 5/1979 | Jochum | 227/10 |
| 4,196,834 | 4/1980 | Beton | 227/10 |
| 4,374,567 | 2/1983 | Combette et al. | 227/10 |
| 4,382,533 | 5/1983 | Buechel et al. | 227/10 |
| 4,577,793 | 3/1986 | Jochum | 227/10 |
| 4,595,134 | 6/1986 | Jochum | 227/9 |
| 4,883,212 | 11/1989 | Philipp | 227/9 |
| 5,657,919 | 8/1997 | Berry et al. | 227/10 |

FOREIGN PATENT DOCUMENTS

| | | |
|---|---|---|
| B1-33675/78 | 2/1978 | Australia . |
| 1 177 087 | 4/1961 | Germany . |
| 2 165 065 | 12/1971 | Germany . |

*Primary Examiner*—Peter Vo
*Assistant Examiner*—James P. Calve
*Attorney, Agent, or Firm*—Knobbe Martens Olson & Bear, LLP.

[57] ABSTRACT

According to the present invention there is provided an explosively-actuated tool for use in setting fasteners into a substrate, comprising a barrel (2), a driving piston (6) mount within the barrel for driving the fastener into a substrate upon detonation of an explosive charge positioned at or adjacent the rear of the barrel, a firing chamber (8) defined in the barrel rearwardly of the piston, and a system capable of controlling the power of the tool by controlled venting of combustion gases from the firing chamber. The power control system comprises an exhaust port arrangement (14) leading from the firing chamber through the wall of the barrel, and a control member (16) for controlling the effective open area of the exhaust port arrangement. Particularly advantageously, the end of the control rod is provided with a concave arcuate control edge (16*b*) which provides a relatively uniform relationship between displacement of the control rod and the degree of opening of the exhaust port arrangement. Such a control edge can be formed by a simple chamfer at the end of a cylindrical control rod (16) with the passage also being cylindrical.

8 Claims, 3 Drawing Sheets

POWER ACTUATED TOOLS WITH POWER ADJUSTMENT MEANS

BACKGROUND OF THE INVENTION

The present invention relates to power actuated tools for driving fasteners into a substrate, and more particularly to such tools which operate by detonation of an explosive charge.

Power actuated tools for driving fasteners such as nails or pins, into a substrate such as a concrete or steel beam, conventionally comprise a barrel from which the fastener is expelled by means of a piston driven by detonation of an explosive charge.

In power actuated tools of this general type, the power output of the tool can be controlled by utilising explosive charges of different power. Alternatively a variable power adjustment system may be incorporated into the tool itself. Such power adjustment systems may operate by altering the volume of the firing chamber defined in the barrel of the tool rearwardly of the piston, or by controlled venting of combustion gases from the portion of the barrel rearwardly of the piston. The present invention relates to an improved power adjustment system which operates by providing a controlled venting of the combustion gases.

SUMMARY OF THE INVENTION

According to the present invention there is provided an explosively-actuated tool for use in setting fasteners into a substrate, comprising a barrel, a driving piston mounted within the barrel for driving the fastener into a substrate upon detonation of an explosive charge positioned at or adjacent the rear of the barrel, a firing chamber defined in the barrel rearwardly of the piston, and means for controlling the power of the tool by controlled venting of combustion gases from the firing chamber, said power control means comprising an exhaust port arrangement leading from the firing chamber through the wall of the barrel and a control member for controlling the effective open area of the exhaust port arrangement.

Advantageously, the exhaust port arrangement comprises one or more radial bores extending through the wall of the barrel. When there are two or more such bores, the bores are in axially-spaced arrangement relative to the barrel.

Advantageously, the exhaust port arrangement opens into an axial bore or other passage within the wall of the barrel, with the control member being defined by a control rod which extends into the passage by an adjustable distance.

Preferably, the control rod extends into the passage from the real end of the passage with the front end of the passage being open for discharge of the gases from the firing chamber via the exhaust port arrangement. Advantageously, the position of the control rod within the passage is controlled by a mechanism operative to cause infinite or stepwise movement of the control rod within the passage. Such a mechanism may be a screw mechanism.

Particularly advantageously, the end of the control rod is provided with a concave arcuate control edge which provides a relatively uniform relationship between displacement of the control rod and the degree of opening of the exhaust port arrangement. Such a control edge can be formed by a simple chamfer at the end of a cylindrical control rod with the passage also being cylindrical.

BRIEF DESCRIPTION OF THE DRAWINGS

An embodiment of the invention will now be described, by way of example only, with reference to the accompanying drawings in which.

DETAILED DESCRIPTION OF THE INVENTION

Figure 1:
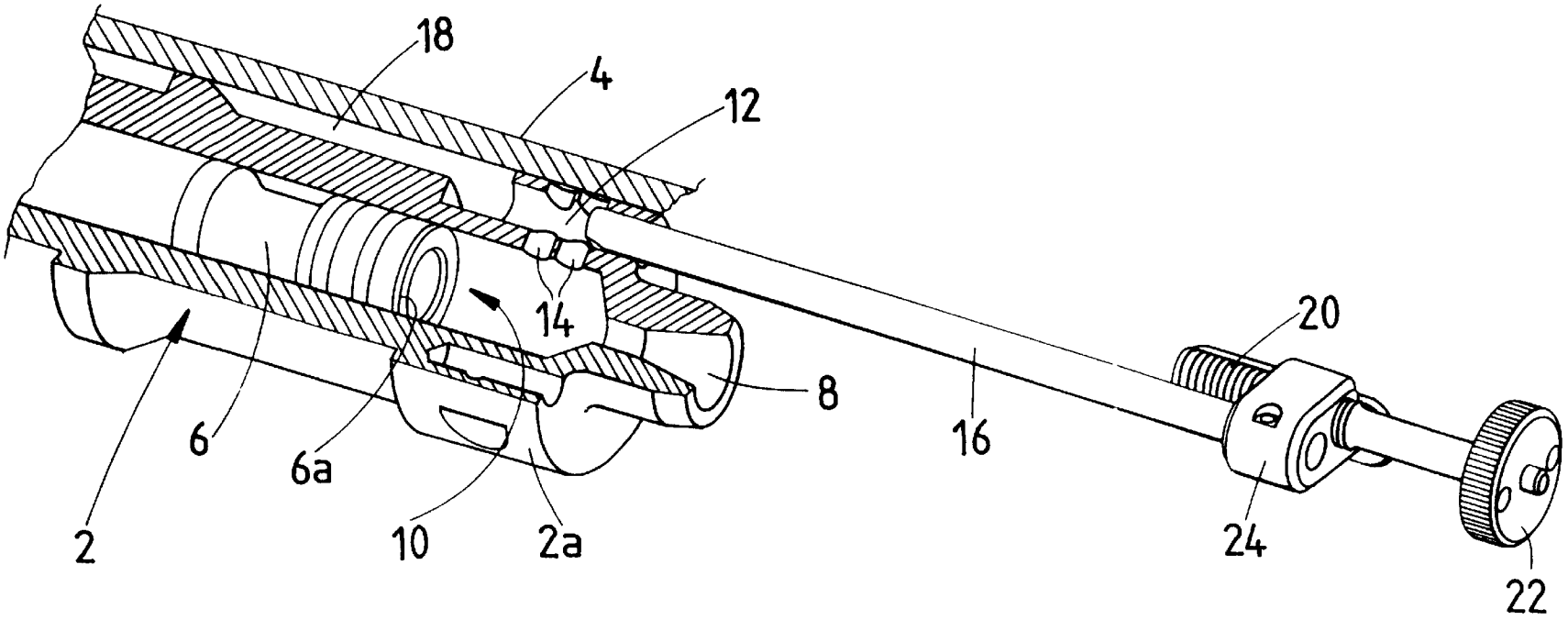
FIG. 1 is a schematic sectional view showing the rear end portion of the barrel of a power actuated tool in accordance with the preferred embodiment of the invention and illustrating in particular a control mechanism for providing controlled venting of combustion gases from the firing chamber.
Figure 2:
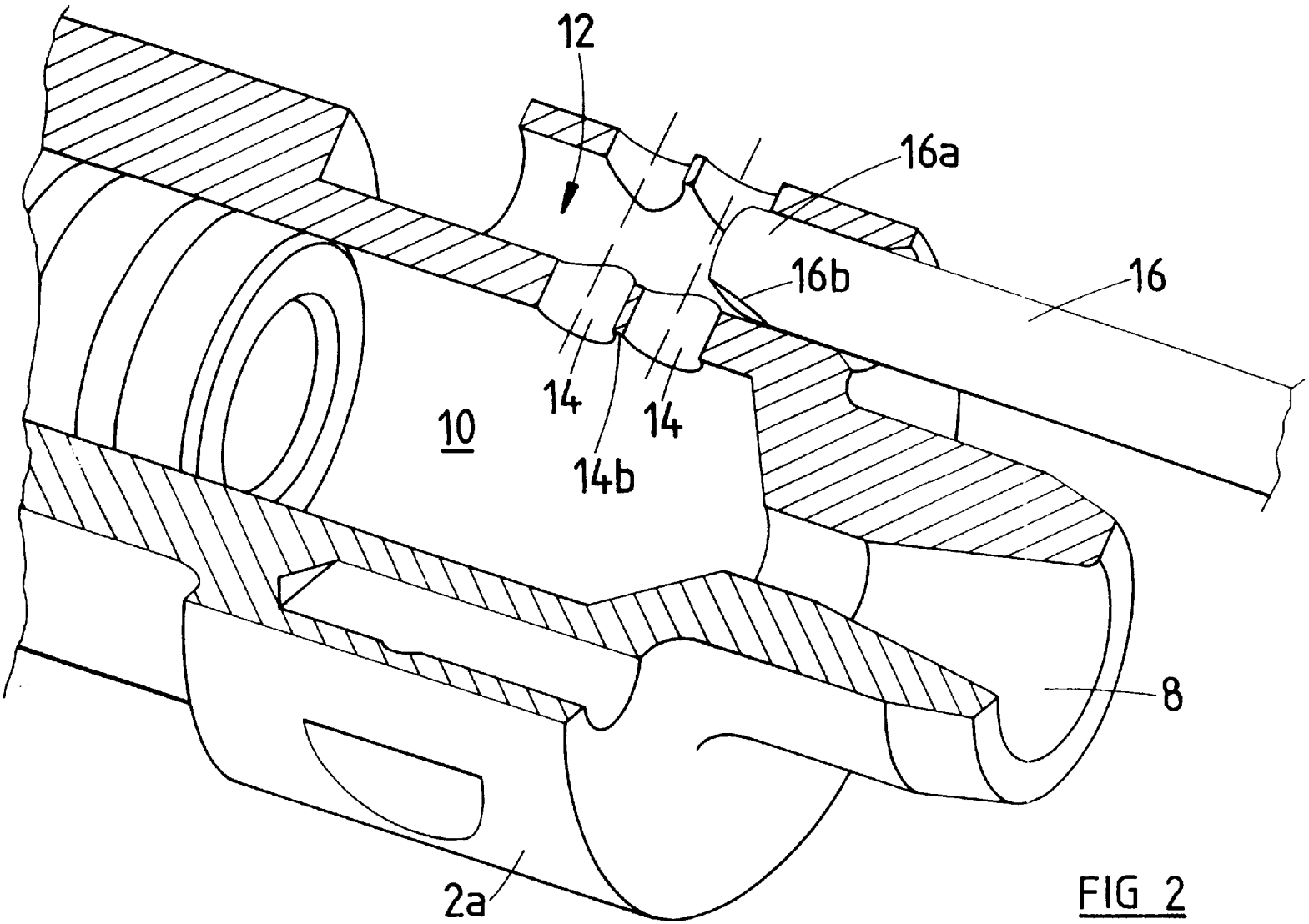
FIG. 2 is an enlarged view similar to FIG. 1 and illustrating in greater detail a control rod of the control mechanism and its relationship with the exhaust port leading from the firing chamber.

FIG. 1 shows part of the barrel 2 of a power actuated tool, the barrel 2 being mounted within a main body 4 of the tool for axial movement. The barrel 2 houses a fastener driving piston 6. A charge chamber 8 is defined at the rear end of the barrel 2 for receiving an explosive charge, and a firing chamber 10 is defined between the rear face 6*a* of the piston 6 and the rear end of the barrel 2. The basic operation of the tool is substantially as described in our earlier applications as afore said, with the axial movement of the barrel 2 within the body 4 serving to facilitate cocking of the tool when the forward end of the barrel 2 is pressed against the work surface, and also to reset the piston 6 within the rear part of the barrel 2 after firing by drawing the barrel 2 forwardly of the body 4.

The power control system for the tool in accordance with the preferred embodiment of the invention will now be described.

The wall 2*a* of the barrel 2 around the firing chamber 10 is of an increased thickness so that its outer diameter closely matches that of the inner surface of the body 4. This section of the barrel wall is provided with an axial through-bore 12 which communicates with the firing chamber 10 via one, two, or more radial passages 14 spaced axially along the bore 12, the or each passage 14 collectively defining an exhaust port. A control rod 16 extends into the axial bore 12 through the rear end thereof and can be positioned to a variable distance within the bore 12 so as to control the effective area of communication between the firing chamber 10 and the axial bore 12 as defined by the open area of the exhaust port, the cross-section of the rod 16 closely conforming to that of the bore 12. As will be apparent, axial movement of the control rod 16 within the bore 12 will cause the forward end portion 16*a* of the rod 16 to move across the outer ends of the passages 14 and hence to open or close the passages 14 to a variable extent. The forward end of the bore 12 opens into an annular space 18 defined between the barrel 2 and the body 4, and this annular space communicates with a main outlet port (not shown) which discharges into the atmosphere. By varying the extent to which the exhaust port defined by the array of passages 14 is open, by varying the axial position of the control rod 16 within the bore 12, a variable quantity of the gases generated on detonation of the explosive charge will be exhausted directly from the firing chamber 10 thereby varying the effective power of the tool. When the exhaust port is fully closed, the tool will be at maximum power for a given charge, and when the exhaust port is fully open, the tool will be at minimum power for a given charge. The control rod 16 is capable of infinitely variable movement or, alternatively, stepwise movement, between the fully open and fully closed configurations of the exhaust port whereby to provide a range of intermediate power positions between the maximum and minimum.

The position of the control rod 16 within the bore 12 can be altered by any form of suitable adjustment mechanism. However, as shown, this is achieved by means of a simple screw mechanism comprising a screw 20 which is journalled in the body of the tool, and which is rotatable by means of a knurled knob 22 which is either located externally of the body, or which projects through a slot in the body to facilitate manipulation by an operator. The threaded shank of the screw 22 is engaged in a threaded block 24 carried at the rear end of the control rod 16. Forwardly of the threaded block 24, the control rod 16 passes through an axial bore within a breach block (not shown) which is mounted within the body 4 immediately rearwardly of the charge chamber 8. The bore in the breach block accurately locates the control rod 16 so that when the barrel 2 is moved forwardly relative to the body to reset the piston 6 after firing, the rear end of the barrel 2 will move forwardly out of engagement with the control rod 16, and when the barrel 2 is returned to its rear position its axial bore 12 will align with the end of the control rod 16 and move over the control rod 16. The knob 22 or the screw 20 may be associated with a detent device to provide a number of discrete adjustment positions between maximum and minimum. The knob 22 may carry suitable markings, or the control rod may be linked to an indicator slide (not shown) so that the power adjustment can easily be determined by the operator.

The passages 14 which define the exhaust port can simply be formed by radial holes formed by drill extending between the outside and inside surfaces of the barrel, with the drillings being axially spaced. This is a much simpler and less expensive process than cutting an elongate slot between the firing chamber and axial bore 12 to provide a port which is capable of selective opening and closure by means of the control rod. As illustrated, the individual holes are spaced so that a land 14*b* is formed between adjacent holes. The formation of an exhaust port of elongate form by means of two or more drilled holes with a land separating adjacent holes also provides advantages over an exhaust port in the form of an elongate slot in that the presence of the or each land between the adjacent holes forms a barrier within the exhaust port itself to unwanted by-pass flow of combustion gas across the peripheral surface of the rear end of the piston where a seal exists between the piston and wall of the barrel.

Figure 3A:
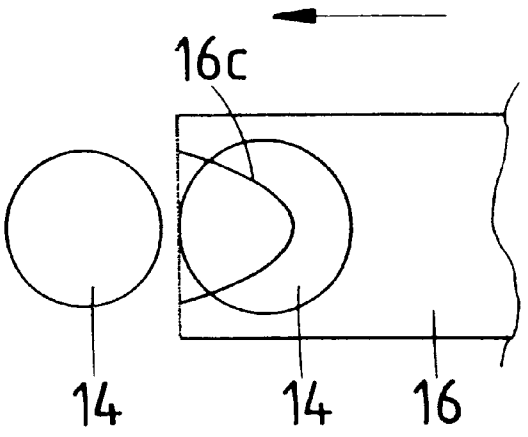
FIGS. 3A to 3C illustrate schematically the progress of the control edge of the control rod across the array of holes forming the exhaust port.
Figure 3B:
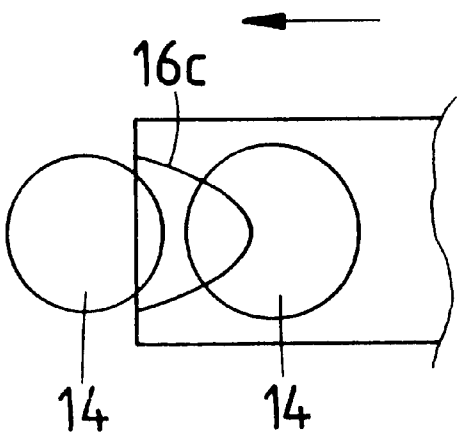
Figure 3C:
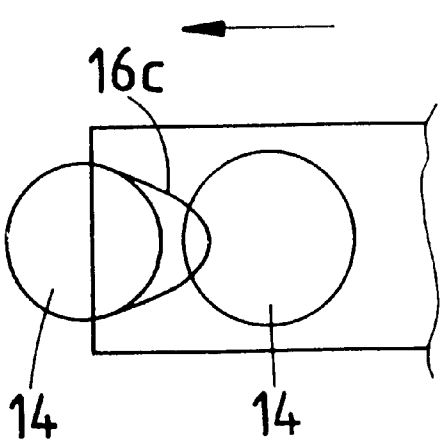

As will be apparent, when the exhaust port is defined by one or more drilled holes, a control rod of a cylindrical shape at its forward end will exhibit an essentially transverse "straight" control edge. As the control edge moves across the circular face of each hole and across the land separating adjacent holes, the relationship between displacement of the control rod and the degree of opening of the exhaust port is very significantly non-linear to the extent that during part of the movement of the control rod where the control edge moves from one hole across the land and onto the adjacent hole, this will not result in any alteration in the effective open area of the exhaust port arrangement. We have overcome this disadvantage by forming the forward end of the control rod 16 with a chamfer 16*b* whereby the effective control edge of the control rod as defined at the base of the chamfer and which traverses the outer faces of the holes 14 is of a concave arcuate form (particularly an elliptical shape) and it is this concave edge which effectively forms the control edge. This is illustrated schematically in FIGS. 3A to 3C which illustrates the progression of control edge (designated as 16*c*) across the array of holes 14 when the control rod 16 is moving in a direction indicated by the arrow to close the exhaust port. It is to be noted that while the control edge 16*c* is moving across the land separating two adjacent holes 14, it is still acting to progressively close the preceding hole 14 and will still do so when it starts to close the following hole. It will be appreciated that throughout the range of movement of the control rod 16 there will always exist a progressive opening or closure of the exhaust port without the significant "flat spot" which is present when a control rod with a plain cylindrical end traverses a land between two adjacent holes. As will also be apparent with an essentially "straight" transverse control edge provided by a plain cylindrical end of a control rod there will be substantial variation in the rate of change of opening/closure as it moves across the face of a cylindrical hole, but with a concave arcuate control edge this rate of change becomes rather more uniform as the control edge moves across the hole. Accordingly the presence of the arcuate concave control edge provided by the chamfer 16*b* will lead to a more uniform relationship between the axial adjustment of the control rod 16 provided by rotation of the screw mechanism and the degree or opening/closure of the exhaust port and hence the power control adjustment; this is achieved irrespective of whether there is a single drilling to form the exhaust port or a series of two or more axially-spaced drillings to form the exhaust port. When the exhaust port consists of two or more drillings, they may be of the same or different diameters to obtain a desired relationship between control rod position and power output.

The embodiment has been described by way of example only and modifications are possible within the scope of the invention.

We claim:

1. An explosively-actuated tool for use in setting fasteners into a substrate, comprising;

a barrel with a longitudinal axis;

a driving piston mounted within the barrel for driving the fastener into a substrate upon detonation of an explosive charge positioned at or adjacent the rear of the barrel;

a firing chamber defined in the barrel rearwardly of the piston; and a system for controlling the power of the tool by controlled venting of combustion gases from the firing chamber, the power control system comprising:

an exhaust port arrangement leading from the firing chamber and having an effective open area for venting combustion gases, and a control member for controlling the effective open area of the exhaust port arrangement, wherein the exhaust port arrangement comprises at least two bores extending radially through the barrel, the bores leading from the firing chamber into an exhaust passage extending substantially parallel to the axis of the barrel and the bores being in axially-spaced arrangement along the axis of the barrel whereby the adjacent bores are separated by a land and each bore has a radial outer end in communication with the exhaust passage, and wherein the control member is defined by a control rod which extends into the exhaust passage by an axially adjustable distance across the radial outer ends of the bores, the control rod having a leading end portion with a concave arcuate control edge operative to provide a generally uniform relationship between displacement of the control rod and the degree of opening of the exhaust port arrangement as the end portion moves across the radial outer ends of the bores and across the land whereby to achieve progressive opening or closure of the exhaust port arrangement throughout the range of movement of the control rod.

2. The tool according to claim 1, wherein the exhaust passage is defined by an axial bore within the wall of the barrel.

3. The tool according to claim 2, wherein the radial bores are drilled through the entire wall thickness of the barrel from the outside of the barrel to the inside of the barrel.

4. The tool according to claim 3, wherein the radial bores are of circular cross-section.

5. The tool according to claim 1, wherein the control rod extends into the passage from a rear end of the passage, a front end of the passage being open for discharge of the gases from the firing chamber via the exhaust port arrangement.

6. The tool according to claim 5, wherein the position of the control rod within the passage is controlled by a screw mechanism.

7. The tool according to claim 1, wherein the control rod and passage are cylindrical and the control edge is formed by a chamfer at the leading end portion of the cylindrical control rod.

8. An explosively-actuated tool for use in setting fasteners into a substrate, comprising:

a barrel with a longitudinal axis;

a driving piston mounted within the barrel for driving the fastener into a substrate upon detonation of an explosive charge positioned at or adjacent the rear of the barrel;

a firing chamber defined in the barrel rearwardly of the piston; and a system for controlling the power of the tool by controlled venting of combustion gases from the firing chamber, the power control system comprising:

a plurality of venting passages leading from the firing chamber through the barrel to an exhaust passage and through which combustion gases can be discharged, the passages extending radially relative to the axis of the barrel and being in axially spaced relation along the axis of the barrel whereby a land exists between adjacent passages, and a control member movable axially across radial outer ends of the passages to control the effective open area of the passages, the control member having a control edge chamfered to provide a generally uniform relationship between displacement of the control member and the effective open area of the passages whereby to provide progressive increase or decrease of the effective open area throughout the range of movement of the control member unaffected by the presence of the land between adjacent passages.

* * * * *